US005377770A

United States Patent [19]

Ritter

[11] Patent Number: 5,377,770

[45] Date of Patent: Jan. 3, 1995

[54] APPARATUS FOR IMPROVING IMPACT TOOL LUBRICATION

[76] Inventor: Lester L. Ritter, 37 Leisure World, Mesa City, Ariz. 85206

[21] Appl. No.: 35,939

[22] Filed: Mar. 23, 1993

[51] Int. Cl.[6] ..... E21B 10/38

[52] U.S. Cl. ..... 175/21; 175/106; 175/296; 175/418

[58] Field of Search ..... 175/19, 21, 92, 106, 175/296, 320, 390, 391, 417, 418

[56] References Cited

U.S. PATENT DOCUMENTS

| | | | |
|---|---|---|---|
| 955,729 | 4/1910 | Welsh | 175/21 |
| 1,005,770 | 10/1911 | Clark | 175/21 |
| 3,763,654 | 10/1973 | Matsushita | 175/19 X |
| 3,885,638 | 5/1975 | Skidmore | 175/390 |
| 4,070,948 | 1/1978 | Tkach et al. | 175/19 X |
| 4,144,941 | 3/1979 | Ritter | 175/19 |
| 4,250,972 | 2/1981 | Schmidt | 175/19 X |
| 4,280,573 | 7/1981 | Sudnishnikov et al. | 175/418 |
| 4,596,292 | 6/1986 | Crover | 175/19 |
| 4,749,050 | 6/1988 | Ritter | 175/19 |

*Primary Examiner*—Roger J. Schoeppel
*Attorney, Agent, or Firm*—Palmatier, Sjoquist & Helget

[57] ABSTRACT

An impact tool having an air-operated hammer for impacting against an anvil in the body of the tool to cause the tool to tunnel through the ground, and having passages and conduits opening to the front region of the tool to pass water to lubricate the tool and wet the soil proximate the front of the tool, to ease the passage of the tool through the soil during the propulsion of the tool.

11 Claims, 1 Drawing Sheet

APPARATUS FOR IMPROVING IMPACT TOOL LUBRICATION

BACKGROUND OF THE INVENTION

The present invention relates to an apparatus for tunneling holes through the ground, as for example air-operated impact devices for tunneling substantially horizontally for the purpose of laying cables or pipes beneath roadbeds or other surface structures.

This invention is related to my earlier U.S. Pat. No. 4,749,050, issued Jun. 7, 1988, which disclosed a tunneling apparatus having lubrication conduits for passing a supply of water to the forward end of the impact tool, thereby wetting the soil surrounding the forward end of the impact tool and reducing the impact resistance of the soil. The prior invention included an elongated outer housing threadably connected to a conically-shaped front tip, wherein the forward end of the front tip has a headpiece mounted thereon which has a discontinuous shoulder and neck section for providing an annular space about the front tip for injecting water. The headpiece has fluid outlets opening into this annular space, through which water or other liquids may be released to lubricate the front tip.

The present invention provides an improvement in the water conduits and outlets proximate the headpiece to increase the lubricating efficiency of the apparatus.

SUMMARY OF THE INVENTION

The present invention comprises a tunneling apparatus having water supply lubricating capabilities, with an elongate housing and a conically-shaped front portion, with a shaft section projecting from the conically-shaped front end and the shaft affixed to a front tip for impacting into soil. Conduits are provided along the elongate outer housing and are joined into conduit channels in the conically-shaped front portion, wherein the channels emerge from the forward end of the front portion adjacent the shaft, to provide a supply of lubricating liquid into the region between the front tip and the conically-shaped front portion.

An advantage of the present invention is that the position of the lubricating conduits improves the lubrication function of the apparatus.

A further advantage of the present invention is that the lubricating conduits are positioned for ease of access and cleaning.

Other and further advantages of the invention will become apparent from the following specification and claims, and with reference to the appended drawings.

BRIEF DESCRIPTION OF THE DRAWINGS

A preferred embodiment of the invention is disclosed hereinafter, with reference to the appended drawings, in which.

DESCRIPTION OF THE PREFERRED EMBODIMENT

Figure 1:
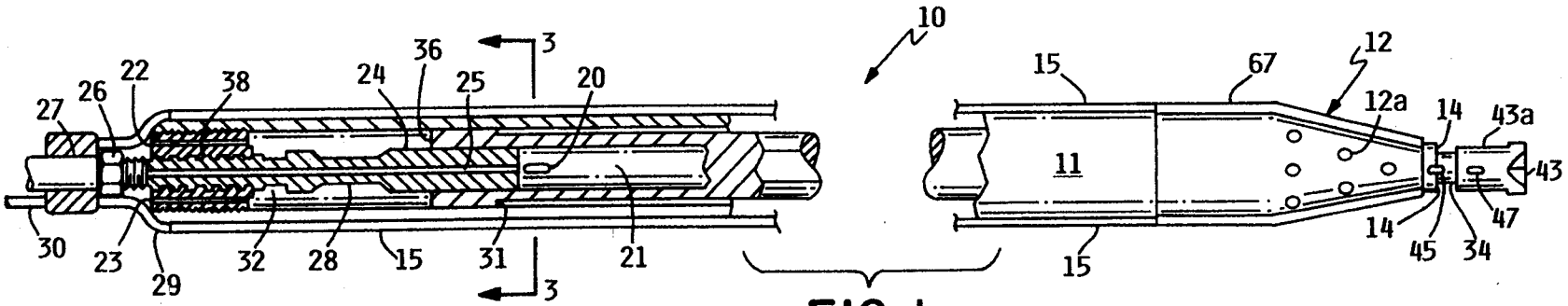
FIG. 1 illustrates the apparatus in plan view and partial cross section.

One form of the impact device is illustrated by the drawings and is described herein as 10. The impact device 10 consists of an elongate cylinder 11 having a conically-shaped front section 12 and enlarged headpiece 43 fitted over the shaft 34 of the anvil portion 17. A plurality of raised, hemispherical buttons **12*a* are spaced about the exterior surface of front section 12, to assist in the operation of the invention. The outer surface of the cylinder 11 includes fluid conduits 15 which are confined within ribs 67 to form internal passages 16 in the front section 12. Passages 16 are formed as slots in ribs 67, sized to receive fluid conduits 15, so as to guide and protect fluid conduits 15 along the front section 12. Passages 16 communicate through the front end of front section 12 to permit fluid conduits 15 to release fluid through the fluid outlets 14**.

The interior of the cylinder 11 includes an anvil 17 and a reciprocable piston 18. The piston 18 is slidably mounted within cylinder 11 and is hollow along part of its interior axial length, but has a solid front piece which comprises a hammer 19. Near the rear end of piston 18 are a plurality of ports 20 which open through flat surfaces 21 formed along the outside surface of piston 18. The rear end of the cylinder is threaded to accept an end cap 22. The end cap 22 has longitudinal ports 23 for permitting the exhausting of compressed air from within cylinder 11 in a manner hereinafter described.

A spool 24 is positioned in slidable relation with the interior surface of the piston 18. The spool 24 has a bore 25 drilled along its axial length which comprises a passage for compressed air into the interior of the impact device 10 and piston 18 via coupler 26 and air hose 27. The rear end of the spool 24 is threadable through the end cap 22 and includes a narrowed diameter 28 immediately forward of the end cap 22. The hose coupler 26 is designed for attachment to a suitable high pressure air hose 27 and when secure attachment is made, it is possible to twist the attached air hose 27 and cause the spool 24 to be threadably movable relative to cylinder 11, thereby causing the front end of spool 24 to move axially within cylinder 11.

The conical portion at the front end of anvil 17 terminates in a forwardly-projecting shaft 34 which extends through the front opening of front section 12. Fluid outlets 14 are adjacent the surface of shaft 34 and the fluid outlets 14 communicate with the fluid passages 16 to enable fluid to flow from the fluid conduits 15 on cylinder 11 to the fluid outlets 14. In the preferred embodiment there are two equally spaced fluid outlets 14.

Figure 2:
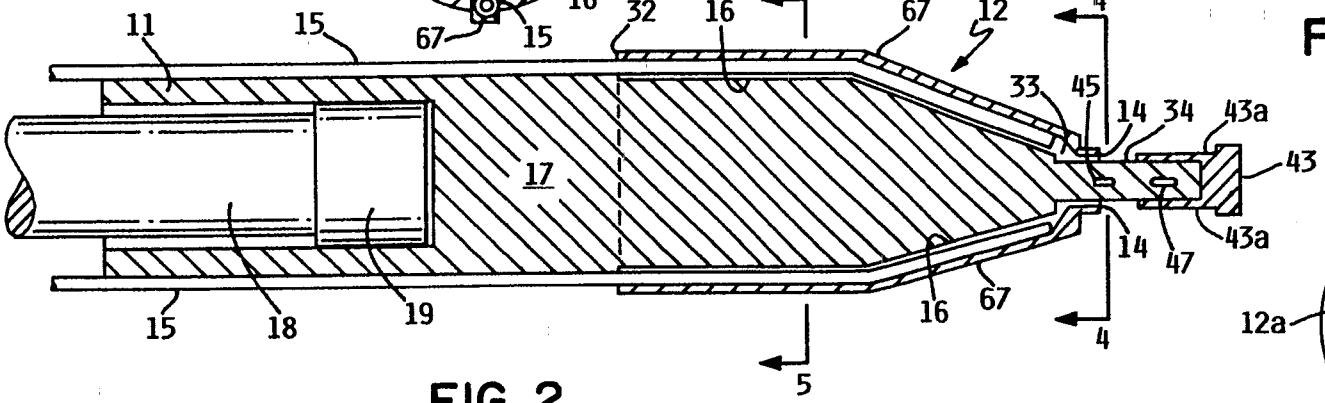
FIG. 2 illustrates an enlarged view of the front of the invention in cross section.

Fluid conduits 15 are affixed against the outside surface of cylinder 11, and each fluid conduit 15 has a front opening into the front portion of a passage 16, and a rear opening sealably connected into a manifold or fluid coupler 29. Fluid conduits 15 are snugly fitted into the passages 16 which take the form of elongate slots or grooves along the inner surface of ribs 67. The grooves emerge from the rear edge 32 of ribs 67, and they converge toward the front of front section 12. The fluid conduits 15 are effectively clamped and held in fluid passages 16 by contact with the outer surface of anvil 17. The front openings of fluid conduits 15 open into a chamber 33 formed proximate the front of front section 12, in flow communication with outlets 14. The fluid coupler 29 is designed for attachment to a suitable fluid hose 30, to permit fluid, preferably water, to flow through the fluid conduits 15 and fluid passages 16 to the fluid outlets 14 located on the front section 12 as shown in FIG. 2. Fluid conduits 15 are preferably made from nylon or other flexible tubing. The fluid hose 30 is preferably connected to an adjustable fluid pump to provide an adjustable fluid supply for controlling the lubrication of the front section 12.

As an alternative construction the fluid hose 30 could be carried inside of air hose 27 and be coupled to a rotatable liquid coupler and seal affixed to the rear of cylinder 11 in the proximate position of fluid coupler 29. As a further alternative construction, the fluid conduits 15 could be constructed in the form of elongate passages through the outer wall of cylinder 11 and along the length of cylinder 11.

Figure 3:
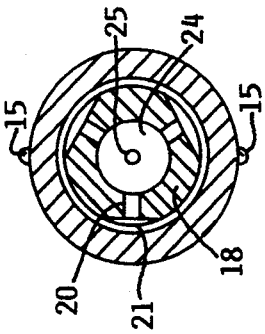
FIG. 3 illustrates the view taken along lines 3—3 of FIG. 1.

FIG. 3 illustrates a view taken along lines 3—3 of FIG. 1, wherein the location of the ports 20 is shown. Each port 20 is positioned to open on a flat surface 21 of the piston 18. The ports 20 provide air communication paths between the interior and exterior of the piston 18. The ports 20 may be covered by the spool 24 during at least a portion of the piston 18 travel distance over the spool 24, and may be uncovered during a further travel portion of piston 18. In the view shown in FIG. 2, the piston 18 is in its forwardmost position, where the ports 20 are uncovered from the spool 24. In its rearmost position, the piston 18 slides rearward over the spool 24 and the ports 20 are uncovered by the narrowed diameter 28 of spool 34. At intermediate positions the ports 20 are blocked by the larger diameter of the spool 24.

Figure 4:
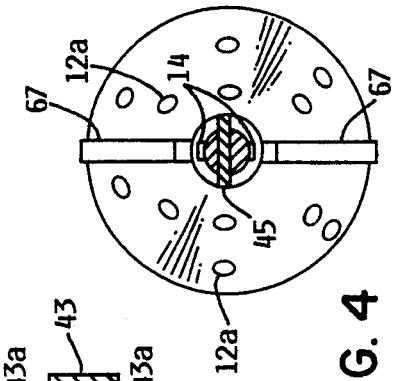
FIG. 4 is a cross section taken along the lines 4—4 of FIG. 2.
Figure 5:
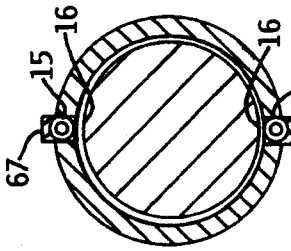
FIG. 5 is a cross section taken along the lines 5—5 of FIG. 2.

FIG. 4 shows a cross-sectional view taken along the lines 4—4 of FIG. 2. The fluid outlets 14 open through the exterior surface of front section 12, and are preferably arranged diametrically opposite each other adjacent the shaft 34 so as to provide a directional fluid flow which permits the region between headpiece 43 and front section 12 to become saturated and allows the surface of front section 12 to become bathed in fluid. The external openings of fluid outlets 14 are preferably arranged behind headpiece 43 so as to create a void to freely permit the flow of fluid into the void. Headpiece 43 preferably has diametrically opposed flats **43*a* which are preferably oriented in alignment with ribs 67. Flats 43*a* permit additional flow of fluid over their respective surfaces, thereby providing additional wetting into the soil in the region where the ribs 67 are oriented. This serves to create a supplementary lubricating effect to ease the passage of ribs 67 through the soil. At the same time, ribs 67 to some extent act as stabilizing fins, to provide some directional stability for the tool as it proceeds through the soil. Outer surfaces of the headpiece 43 may also be flattened so as to provide a space for the further flow of fluid over headpiece 43**.

A wedge-shaped key 45 is forcibly inserted through a slot in shaft 34, to bear against the front edge of front section 12, and thereby to affix front section 12 to the cylinder 11. A detent groove may be provided in the front edge of front section 12 to locate the key 45, and the key 45 may be removed from its position by reversibly tapping the key with a hammer. A similar wedge-shaped key 47 affixes headpiece 43 onto shaft 34. Wedge-shaped key 47 is forcibly engaged into locking position so as to firmly attached headpiece 43 to shaft 34. Key 47 may be removed by tapping the key to dislodge it from locking engagement.

In operation, compressed air is applied via the air pressure hose 27, attached to the coupler 26. The compressed air passes through the bore 25 to the interior of piston 18 and exerts a forward driving force against the piston 18. This force causes the piston 18 to move sharply ahead, contacting the hammer 19 against the anvil 17. At its forwardmost position, piston 18 uncovers the ports 20 and the internally pressurized air is vented to the exterior of the piston 18. This vented air passes through the openings created by the flat surfaces 21 on the exterior surface of piston 18, and inside the interior of cylinder 11, and act upon the rear annular piston surface 31 to sharply drive the piston 18 in a rearward direction. The piston 18 proceeds rearwardly until the ports 20 again become uncovered by the narrow diameter 28 of the spool 24. At this point, the compressed air between the piston 18 and the interior surface of cylinder 11 is vented into the rear chamber 32, and then out the longitudinal ports 23 through the end cap 22. When the piston 18 is in its rearward position, compressed air entering via the bore 25 again acts to drive the piston 18 forwardly to repeat the cycle.

Each time the hammer 19 contacts the anvil 17, the headpiece 43 on the front of shaft 34 is forced forwardly into the soil. As the headpiece 43 moves through the soil, fluid is released through the fluid outlets 14, thereby lubricating the front surfaces of the tool, and wetting the soil in the region around the front end of the tool. The soil wetting process tends to loosen the adhesion of the soil and to make it easier for the tool to move forwardly through the soil.

The spool 24 may be threadably moved along its axis in either direction, thereby varying the stroke range of the piston 18. For example, if spool 24 is positioned in its forward axial position as shown in FIG. 1, the stroke of the piston 18 causes the hammer 19 to sharply contact the anvil 17, and produce a forward-driving impulse. Conversely, if the spool 24 is threaded toward the end cap 22, the stroke of the piston 18 may be shifted so as to prevent any contact between the hammer 19 at the anvil 17. If the spool 24 is fully retracted toward the end cap 22, the stroke of the piston may be adjusted so as to cause contact between the rear outer piston surface 36 against the end cap 22, to create a reverse-driving impulse and cause the apparatus to move in a rearward direction.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. In an impact device for tunneling through the ground, having an elongate cylinder with an air reciprocable piston and hammer therein and means for reciprocating said piston and hammer to cause forwardly or rearwardly impacting against respectively front and rear ends of said cylinder, wherein the forward portion of said cylinder forms a narrowing conical taper joined to a forwardly-projecting shaft, the improvement comprising a front end piece sized for fitting over the forward portion of said cylinder, the front piece having a forward opening sized to permit passage of the forwardly-projecting shaft; a first slot through said forwardly-projecting shaft proximate the front end of said front piece; and a locking key inserted through said first slot; at least one slotted passage running along the inside surface of said front piece from the forward opening to the rear edge of said front piece; an enlarged headpiece affixed to said forwardly-projecting shaft at a spaced-apart distance from said front piece forward opening; and at least one fluid conduit along said elongate cylinder and fitted into said at least one slotted passage, said conduit having a front opening in said slotted passage and a rear opening proximate the rear end of said cylinder; and means for coupling a source of fluid to said conduit rear opening.

2. The apparatus of claim 1, further comprising a second slot through said forwardly-projecting shaft; a third slot through said headpiece; and a locking key inserted through said second and third slots.

3. The apparatus of claim 1, wherein said front end piece further comprises an exterior surface having a plurality of raised projections thereon.

4. The apparatus of claim 3, wherein said headpiece further comprises an exterior surface having flat surface portions thereon.

5. The apparatus of claim 1, wherein said at least one slotted passage in said front piece further comprises two slotted passages running along the inside surface of said front piece at diametrically opposite positions.

6. The apparatus of claim 5, wherein said at least one fluid conduit further comprises two fluid conduits, each fluid conduit fitted into one of said passages.

7. The apparatus of claim 6, further comprising means for affixing said front piece tightly against said narrowing conical taper.

8. An impact device for tunneling through the ground, comprising:

a) a cylinder having inner and outer surfaces and front and rear ends, said front end having a narrowed conical taper and a forwardly-projecting shaft; said forwardly-projecting shaft having a first slot therethrough, and a locking key inserted through said first slot;

b) said cylinder having a reciprocable hammer therein, being in contacting relation with an anvil on said inner surface of said cylinder;

c) a front piece attached to said cylinder front tip, said front piece having fluid passages therein which open to an exterior front surface of said front piece; said front piece exterior surface comprising a forwardly narrowing taper and said front piece inner surface comprising a narrowing taper sized for snugly fitting over said cylinder front end; and said front piece having a forward opening sized to accept passage of said forwardly-projecting shaft;

d) a headpiece affixed to the front end of said forwardly-projecting shaft; and e) means for coupling fluid flow to said fluid passages.

9. The apparatus of claim 8, wherein the headpiece is affixed to said shaft and spaced forwardly of said front piece, and the front opening of said fluid passages is adjacent said shaft.

10. The apparatus of claim 9, wherein said fluid passages are spaced evenly about the interior surface of said front piece.

11. The apparatus of claim 10, further comprising fluid conduits along said outer surface of said cylinder in flow communicating relation to said fluid passages.

* * * * *